United States Patent [19]

Goodman et al.

[11] 4,213,668

[45] Jul. 22, 1980

[54] ELECTRICAL CONTACT

[75] Inventors: David S. Goodman, Mission Viejo; George I. Stanfield, Tustin, both of Calif.

[73] Assignee: International Telephone and Telegraph Corporation, New York, N.Y.

[21] Appl. No.: 949,496

[22] Filed: Oct. 10, 1978

[51] Int. Cl.[3] ..... H01R 9/02

[52] U.S. Cl. ..... 339/217 R

[58] Field of Search ..... 339/17 C, 217 R, 217 PS, 339/275 T, 276, 17 R, 17 LC, 17 L; 29/630 D; 72/341; 174/194; 76/110

[56] References Cited

U.S. PATENT DOCUMENTS

| | | | |
|---|---|---|---|
| 2,958,065 | 10/1960 | Flanagan | 339/17 R |
| 3,040,292 | 6/1962 | Bernard et al. | 339/630 D UX |
| 3,158,418 | 11/1964 | Rush | 339/217 PS X |
| 3,315,220 | 8/1967 | Flanagan | 339/276 R X |
| 3,870,839 | 3/1975 | Almich et al. | 339/17 LC X |

*Primary Examiner*—Roy Lake
*Assistant Examiner*—Eugene F. Desmond
*Attorney, Agent, or Firm*—Thomas L. Peterson

[57] ABSTRACT

A one-piece unitary right-angle electrical contact is made by cold heading a segment of bar stock to form a cylindrical body having a flat strip thereon coplanar with the center axis of the body. The flat strip is milled transversely to form terminal posts of rectangular cross-section which are integral with the body of the contact.

3 Claims, 5 Drawing Figures

ELECTRICAL CONTACT

BACKGROUND OF THE INVENTION

This invention relates generally to an electrical contact and, more particularly, to a right-angle contact which embodies terminal posts that extend transversely of the axis of the contact body.

It is conventional practice in the connector industry to manufacture electrical contacts having cylindrical bodies by machining, although cold heading processes have recently been adopted for forming the contacts in order to reduce manufacturing costs and losses due to scrap material inherent in machining processes. In order to form a right-angle contact having a cylindrical body, it has been the practice to drill transverse holes in the body of the contact and press fit either circular or rectangular cross-section posts into the holes. The machining of the holes and press fitting of the posts therein adds considerably to the manufacturing costs of the contact. Furthermore, the junction formed between the posts and the contact body creates an undesired voltage drop between the contacting portion of the contact body and the posts.

U.S. Pat. Nos. 3,239,792; 3,409,862; and 3,618,207 disclose flat contacts having terminal posts which are formed by stamping or milling operations. Such operations are readily performed on flat sheet stock, but are extremely difficult to perform on solid stock, such as required for producing contacts having cylindrical bodies. It is also known in the art to form a plurality of rectangular cross-section terminal posts on a cylindrical bar stock, which posts extend parallel to the center axis of the bar, by performing a series of milling cuts at right angles to each other. This method is extremely expensive, and does not produce a right-angle contact.

It is, therefore, the object of the present invention to provide a method for producing a one-piece unitary right-angle electrical contact having a cylindrical body at an expense substantially less than that of the prior art methods discussed above.

SUMMARY OF THE INVENTION

According to one aspect of the present invention, there is provided a one-piece unitary electrical contact comprising a generally cylindrical body having a forward mating end and a rear termination end. There is provided at least one terminal post of rectangular cross-section integral with the body and extending transversely of the center axis of the body. Since the terminal post is integral with the contact body, the undesired voltage drop which exists in the prior art right-angle contact having a cylindrical body has been eliminated.

According to another aspect of the present invention, there is provided a method for making the aforementioned contact comprising the steps of cold heading a segment of bar stock to form a generally cylindrical body having a forward contact mating end and a rear end embodying a flat strip coplanar with the center axis of the body. The strip is milled transversely thereof to form one or more terminal posts. A milling cut in only one direction is required to form a post in the flat strip, and the milling operation is easy to perform because the strip is relatively narrow. Thus, the present invention combines the advantages of low manufacturing costs and elimination of scrap by cold heading the contact body, with the advantages of milling by providing a narrow flat strip on the contact body during the cold heading process, which allows the terminal posts to be formed by making milling cuts in only one direction, namely, perpendicular to the flat strip. Thus, the method of the present invention allows the inexpensive manufacture of a one-piece unitary right-angle contact having a cylindrical body.

DESCRIPTION OF THE PREFERRED EMBODIMENT

Figure 1:
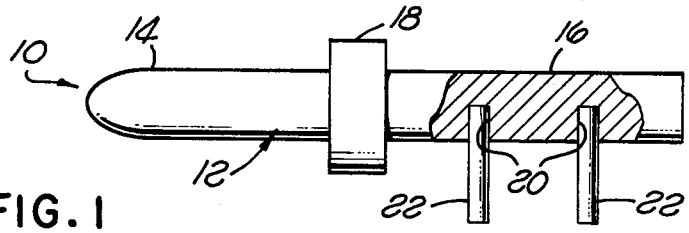
FIG. 1 PRIOR ART
FIG. 1 is a partial longitudinal sectional view through a prior art right-angle contact having terminal posts press-fit into holes in the cylindrical body of the contact.

Referring now to FIG. 1 of the drawings, there is illustrated a typical prior art right-angle contact, generally designated 10, having a cylindrical body 12 embodying a forward contact mating end 14, in the form of a pin contact, and a rear termination end 16 separated from the forward end by an annular enlargement 18. The contact body is formed either by machining or cold heading. Thereafter, radial bores 20 are formed in the termination end 16 of the contact body. Either circular or rectangular cross-section terminal posts 22 are then press-fit into the bores 20 to produce the right-angle contact, which has the disadvantages discussed previously herein.

Figure 2:
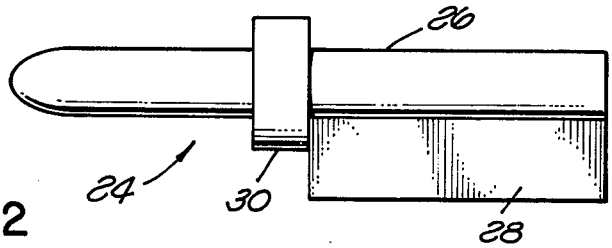
FIG. 2 is a side elevational view of the contact body of the present invention formed by the cold heading process.
Figure 3:
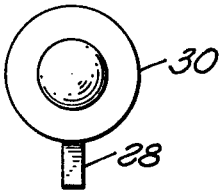
FIG. 3 is a front end view of the contact illustrated in FIG. 2.
Figure 4:
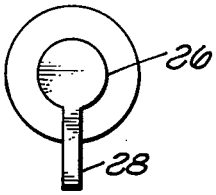
FIG. 4 is a rear view of the contact illustrated in FIG. 2.
Figure 5:
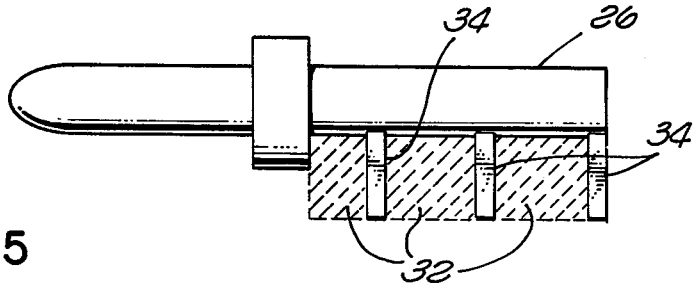
FIG. 5 is a side elevational view of the contact illustrated in FIG. 2 showing where the milling cuts are made in the flat strip of the contact body to produce the terminal posts of the contact.

In accordance with the present invention, the contact body 24, illustrated in FIG. 2, is formed by cold heading. The contact is identical to the body 12 but during the cold heading process, there is provided on the rear termination end 26 of the body a relatively narrow, flat strip 28 which is coplanar with the center axis of the body and extends from the annular enlargement 30 of the contact body to the rear of the body. The flat strip 28 is then milled transversely at longitudinally spaced locations, as shown in the shaded areas indicated by reference numeral 32 in FIG. 5 to form a plurality of openings in the flat strip, thereby producing a plurality of rectangular cross-section terminal posts 34. It will be appreciated that the posts extend transverse to the center axis of the contact body, and lie in a common plane passing through the center axis of the body. Because the strip 28 is relatively narrow, it can be rapidly milled, by using conventional milling equipment, so as to produce the terminal posts 34 at relatively low expense.

We claim:

1. A one-piece unitary right-angle electrical contact comprising:

an elongated, solid body having a cylindrical forward mating end and a rear termination end;

said rear-termination end including a cylindrical portion coaxial with said cylindrical forward mating end and a plurality of terminal posts each of rectangular cross-section integral with said cylindrical portion; and said terminal posts extending transversely in the same direction from said cylindrical portion and lying in a common plane passing through the center axis of said cylindrical portion.

2. A method of making a one-piece unitary right-angle electrical contact having an integral terminal post comprising the steps of:

cold heading a segment of bar stock to form a generally cylindrical body having a forward contact mating end and a rear end embodying a flat strip coplanar with the center axis of said body; and milling said strip transversely thereof at longitudinally spaced locations to form a plurality of rectangular openings therein thereby producing a plurality of said terminal posts.

3. A method of making a one-piece unitary electrical contact having an integral terminal post comprising the steps of:

cold heading a segment of bar stock to form a generally cylindrical body having a forward contact mating end, a rear end embodying a flat strip coplanar with the center axis of said body, and an annular enlargement between said forward mating end and said flat strip; and milling said strip transversely thereof to form said terminal post.

* * * * *